US007726483B2

(12) United States Patent
Ramanujam et al.

(10) Patent No.: US 7,726,483 B2
(45) Date of Patent: Jun. 1, 2010

(54) STACKED CONTAINERS

(75) Inventors: Anand Ramanujam, Arlington, IL (US); Ryan J. Coonce, Elmhurst, IL (US)

(73) Assignee: The Glad Products Company, Oakland, CA (US)

( * ) Notice: Subject to any disclaimer, the term of this patent is extended or adjusted under 35 U.S.C. 154(b) by 655 days.

(21) Appl. No.: 11/065,395

(22) Filed: Feb. 23, 2005

(65) Prior Publication Data

US 2006/0186014 A1 Aug. 24, 2006

(51) Int. Cl.
*B65D 21/00* (2006.01)

(52) U.S. Cl. ..... 206/508; 206/501; 206/503; 206/499; 220/380; 220/781

(58) Field of Classification Search ..... 206/508, 206/501, 203, 499, 503; 220/380, 781
See application file for complete search history.

(56) References Cited

U.S. PATENT DOCUMENTS 3,107,028 A 10/1963 De Robertis
3,883,036 A * 5/1975 Mahaffy et al. ..... 220/781
3,931,890 A 1/1976 Davis
3,954,178 A * 5/1976 Mason, Jr. ..... 206/508
4,076,123 A 2/1978 Davis
4,154,360 A * 5/1979 Smith ..... 220/258.3
4,194,645 A * 3/1980 Zabner et al. ..... 220/781
4,275,815 A * 6/1981 Davis ..... 206/508
4,421,244 A * 12/1983 Van Melle ..... 220/781
4,700,842 A * 10/1987 Grusin ..... 206/508
4,703,857 A * 11/1987 Jahnen et al. ..... 206/503
4,747,510 A 5/1988 Mack
4,877,151 A * 10/1989 Rush et al. ..... 206/514
4,896,184 A 1/1990 Kamitamari et al.
4,951,832 A 8/1990 Tenney et al.
5,184,745 A 2/1993 Havens et al.
5,253,781 A 10/1993 Van Melle et al.
5,377,860 A * 1/1995 Littlejohn et al. ..... 220/790
5,385,255 A 1/1995 Varano et al.
5,409,128 A 4/1995 Mitchell (Continued)

FOREIGN PATENT DOCUMENTS

WO WO 2004/049866 A1 6/2004

(Continued)

*Primary Examiner*—Anthony Stashick
*Assistant Examiner*—Christopher B McKinley
(74) *Attorney, Agent, or Firm*—Thomas C Feix; David Peterson

(57) ABSTRACT

The container can be locked into a stack of containers. A container cover locks onto the top of a container base to define a sealed area for storage. Additionally, the bottom of a second container base can be locked onto the top of the cover of a first container. In this fashion, when closed containers are stacked, they form a locked stack that is more structurally rigid and therefore less precarious than a traditional, non-locked container stack. When not in use, the bases can be formed into a nested stack, and their covers can be locked together to form a locked cover stack. The locked cover stack can be locked to either the top or bottom of the nested base stack to form a rigid stack. In some embodiments, a cover can be turned upside down and its bottom face locked onto the bottom face of a base.

18 Claims, 22 Drawing Sheets

U.S. PATENT DOCUMENTS

| | | | | | |
|---|---|---|---|---|---|
| 5,419,451 | A | | 5/1995 | Bitel, Jr. | |
| 5,586,656 | A | * | 12/1996 | Abrums | 206/501 |
| 5,692,617 | A | * | 12/1997 | Adams | 206/508 |
| 5,868,268 | A | | 2/1999 | Walker | |
| 5,881,880 | A | | 3/1999 | Jacques et al. | |
| 5,979,690 | A | | 11/1999 | Hartley | |
| 6,152,318 | A | * | 11/2000 | Walker | 220/379 |
| 6,158,607 | A | | 12/2000 | Wallberg | |
| 6,164,483 | A | | 12/2000 | Walker | |
| 6,170,969 | B1 | | 1/2001 | Dumse | |
| 6,467,647 | B1 | | 10/2002 | Tucker et al. | |
| 6,685,049 | B1 | * | 2/2004 | Paladino | 220/781 |
| 7,017,775 | B2 | * | 3/2006 | Zettle et al. | 220/781 |
| 7,258,905 | B2 | * | 8/2007 | Whitmore et al. | 428/35.7 |
| 7,264,135 | B2 | * | 9/2007 | Savicki et al. | 220/781 |
| 2001/0047994 | A1 | * | 12/2001 | von Holdt, Jr. | 220/276 |
| 2003/0155267 | A1 | | 8/2003 | Mercier et al. | |

FOREIGN PATENT DOCUMENTS

| | | | |
|---|---|---|---|
| WO | WO 2004/049867 | A1 | 6/2004 |
| WO | WO 2004/049880 | A1 | 6/2004 |
| WO | WO 2004/050513 | A2 | 6/2004 |
| WO | WO 2005/002409 | A1 | 1/2005 |

* cited by examiner

STACKED CONTAINERS

FIELD OF THE INVENTION

The present invention relates generally to containers, and, more particularly, to containers that lock together when stacked.

BACKGROUND OF THE INVENTION

Rigid, thermoplastic food containers are generally known. Users often accumulate a large number of these containers in different sizes and shapes. When not in use, the containers are often stored haphazardly into drawers. In this case, the unused containers take up a great deal of room, and finding a matching base and cover in a disarranged drawer may be difficult. To avoid this, some users stack the containers in cabinets. While the bases of the containers usually nest and therefore take up less room than in a disorganized drawer, it may still be difficult to match a base with a cover. In addition, the covers may not stack and the covers may tend to topple down. When the containers are in use to store food, the containers are often stacked one on top of another in cabinets or in a refrigerator. These stacks may be precarious, and their fall may cause food to spill from the container. Many users would find it desirable if the containers, whether empty or in use, could be stored in a manner space efficient, less precarious, and more structurally rigid. The present invention has as a general aim to provide such containers.

SUMMARY OF THE INVENTION

In view of the foregoing, the present invention provides a container that can be locked into a stack of containers. A container cover locks onto the top of a container base to define a sealed area for storage. Additionally, the bottom of a second container base can be locked onto the top of the first container's cover. In this fashion, when closed containers are stacked, they form a locked stack that is more structurally rigid and therefore less precarious than a traditional, non-locked container stack.

When the containers are not in use, their bases can be formed into a nested stack, and their covers can be locked to one another to form a locked cover stack. The locked cover stack can be locked to either the top or bottom of the nested base stack to form a rigid stack.

In some embodiments, a cover can be turned upside down and its bottom face locked onto the bottom face of a base.

In some embodiments, the container cover includes a first closure portion and a first engagement portion, and the base includes a second closure portion and a second engagement portion. The first closure portion of the cover is sealingly engageable with the second closure portion of the base to define a substantially sealed, leak-proof, and re-sealable storage area for items such as food. The first engagement portion of the cover is engageable with the second engagement portion of a second base to form the beginnings of a locked container stack. The first closure portion of the cover is engageable with the first closure portion of a second cover to form a locked cover stack. In some embodiments, the cover includes a third engagement portion which engages with the third engagement portion of a second cover when forming a locked cover stack.

The covers and bases can be economically constructed from relatively thin-gauge plastic so that the user can either wash them after use or dispose of them with the view that their purchase price allows them to be used as a consumable good.

The container can be readily manufactured, for example, with conventional thermoforming equipment. The cover can be made from a semi-transparent material to ensure satisfactory visibility of the container's contents. The container can be suitable for refrigerator, freezer, microwave, and machine dishwasher use.

The features of the present invention will become apparent to one of ordinary skill in the art upon reading the detailed description, in conjunction with the accompanying drawings, provided herein.

DETAILED DESCRIPTION OF THE INVENTION

Figure 1:
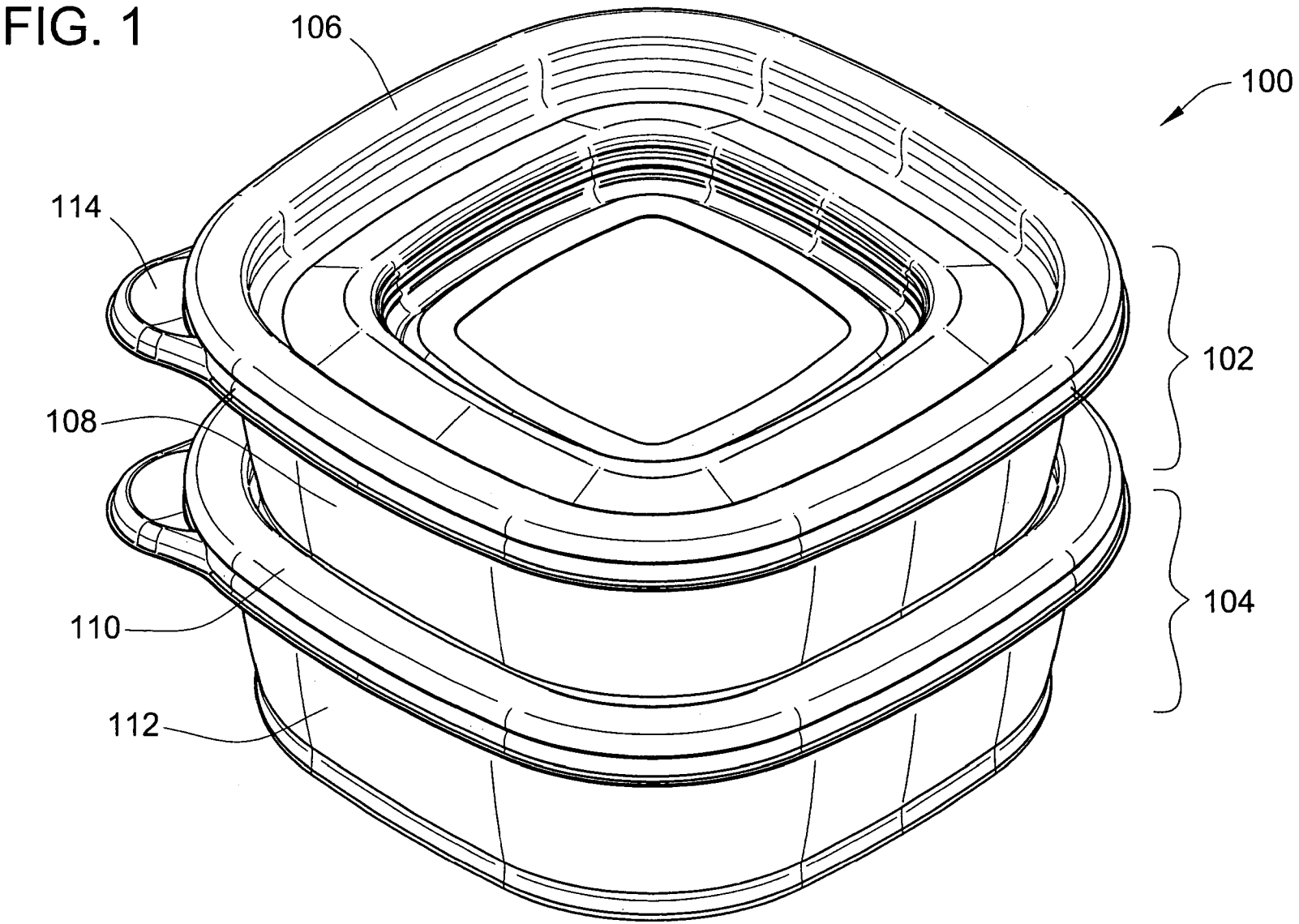
FIG. 1 is an isometric view of a locked stack of two containers according to an embodiment of the present invention.

Turning to the drawings, wherein like reference numerals refer to like elements, a first embodiment of the present invention is illustrated in FIGS. 1 through 5. A locking container stack 100 includes, in the example of FIG. 1, two sealed containers 102 and 104. Container 102 includes a flexible cover 106 sealingly engaged to a base 108, while container 104 similarly includes a cover 110 sealingly engaged to its base 112. To form the locking container stack 100, the top surface of cover 110 is locked to the bottom surface of base 108. Locking containers 102 and 104 together make the resultant stack 100 more structurally rigid and thus less precarious than a traditional, non-interlocked, stack of containers would be.

The container cover 106 can include at least one gripping tab 114 to facilitate removal of the cover 106 from the container base 108. In some embodiments, the gripping tab 114 includes one or more cross-ribs or a textured surface to improve a user's grip on the tab 114.

Figure 2:
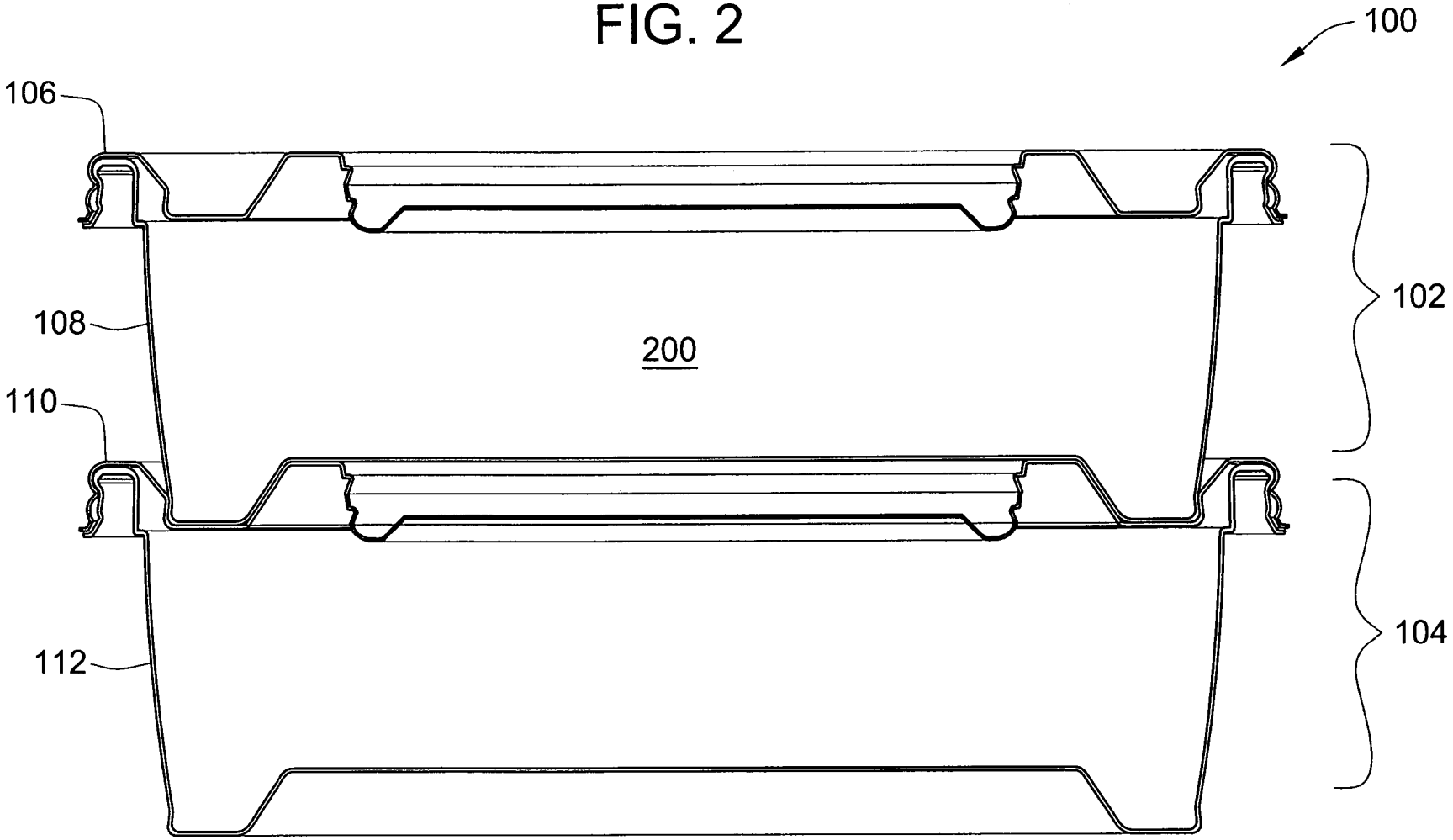
FIG. 2 is a side sectional view of the locked container stack of FIG. 1.

In the sectional view of FIG. 2 can be seen storage area 200 of container 102, defined when the cover 106 is sealingly engaged with the base 108. FIG. 2 also shows how the base 108 of the upper container 102 engages with the cover 110 of the lower container 104 to form the locking container stack 100. In the particular embodiment shown in FIG. 2, the containers 102 and 104 use outside seals. The present invention can be embodied with a variety of closure designs including outer closures and inner closures.

Figure 3:
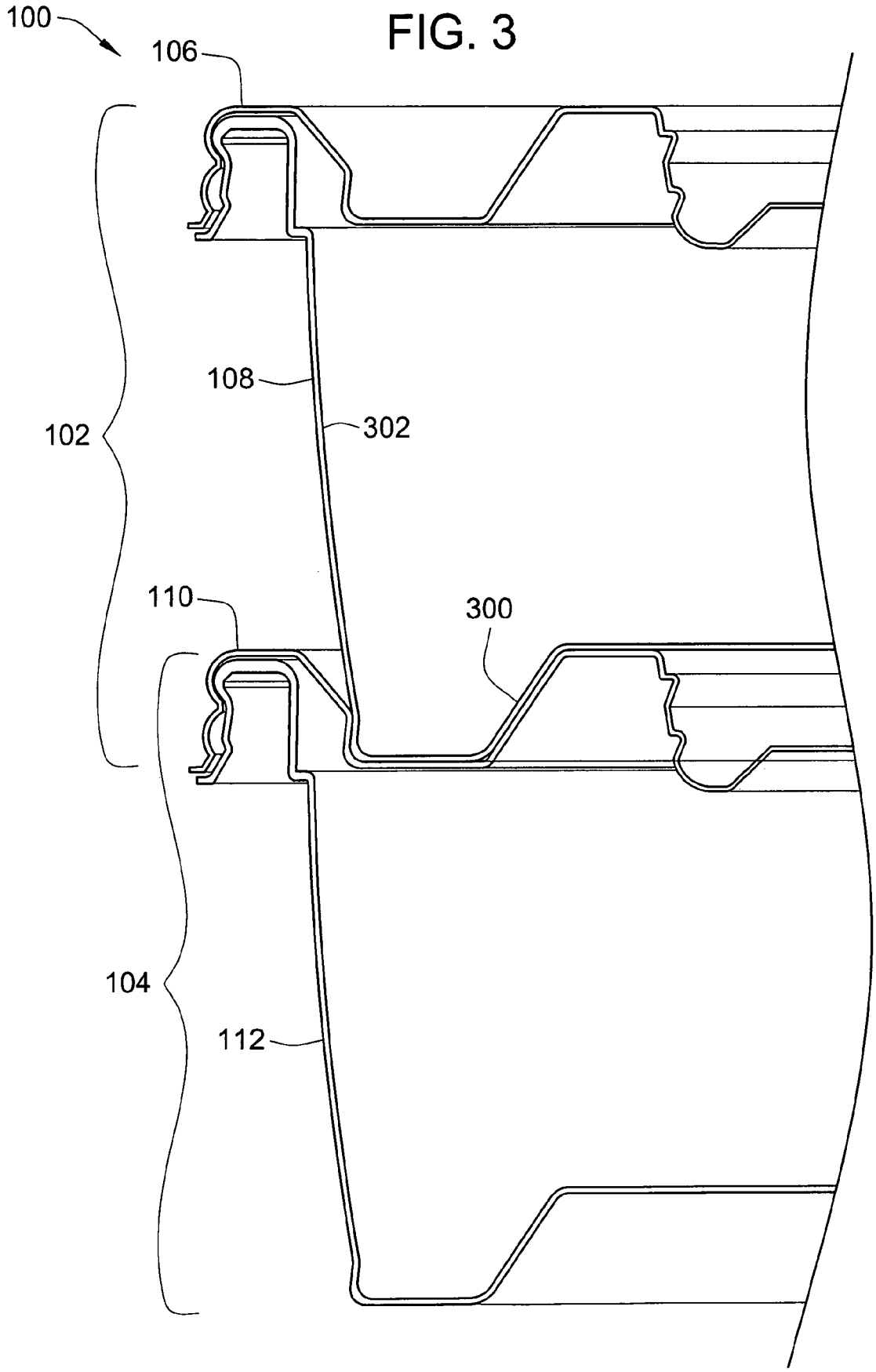
FIG. 3 is an enlarged, detail view of the area indicated in FIG. 2.
Figure 4:
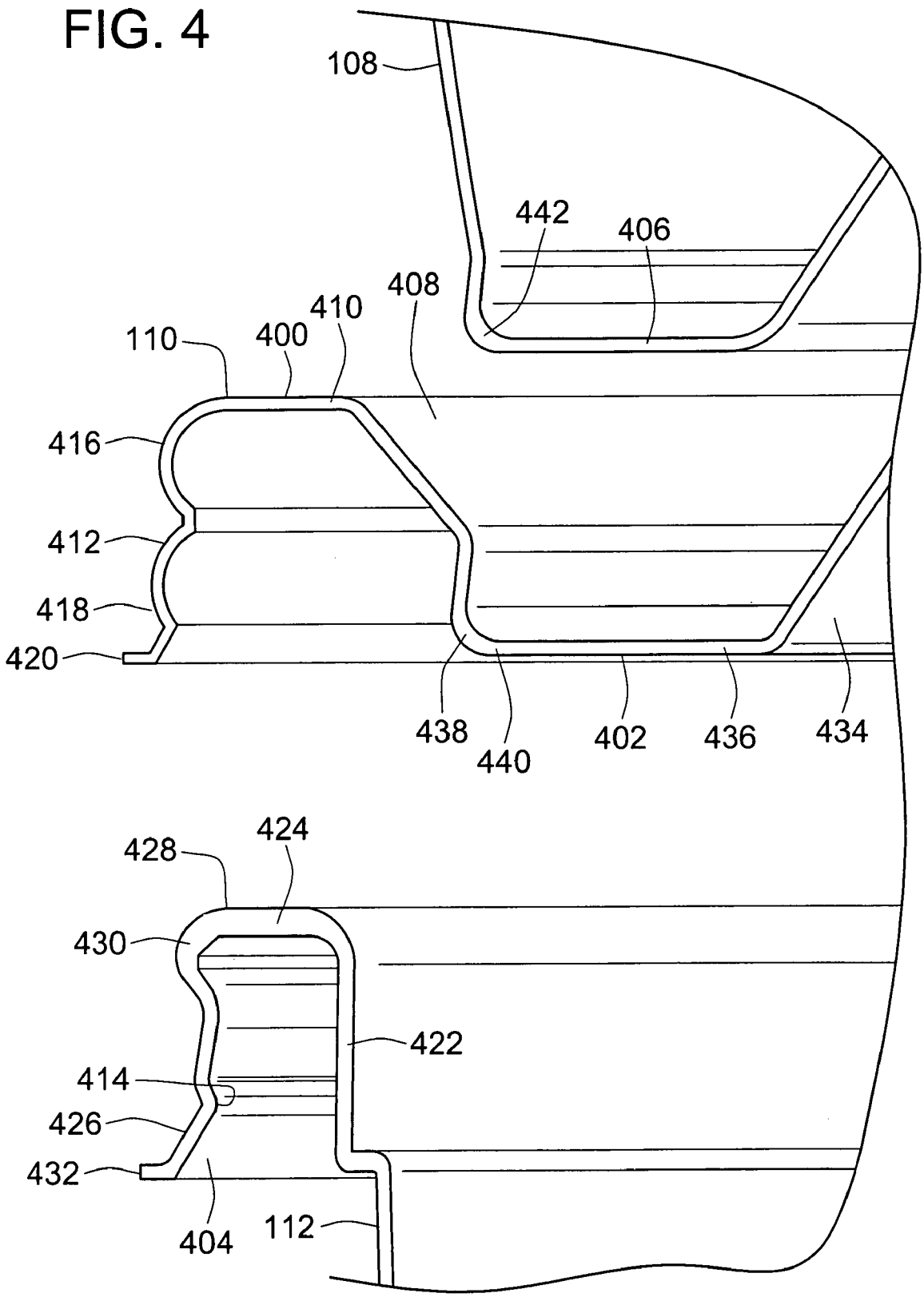
FIG. 4 is an enlarged, detail view of the area indicated in FIG. 3.
Figure 5:
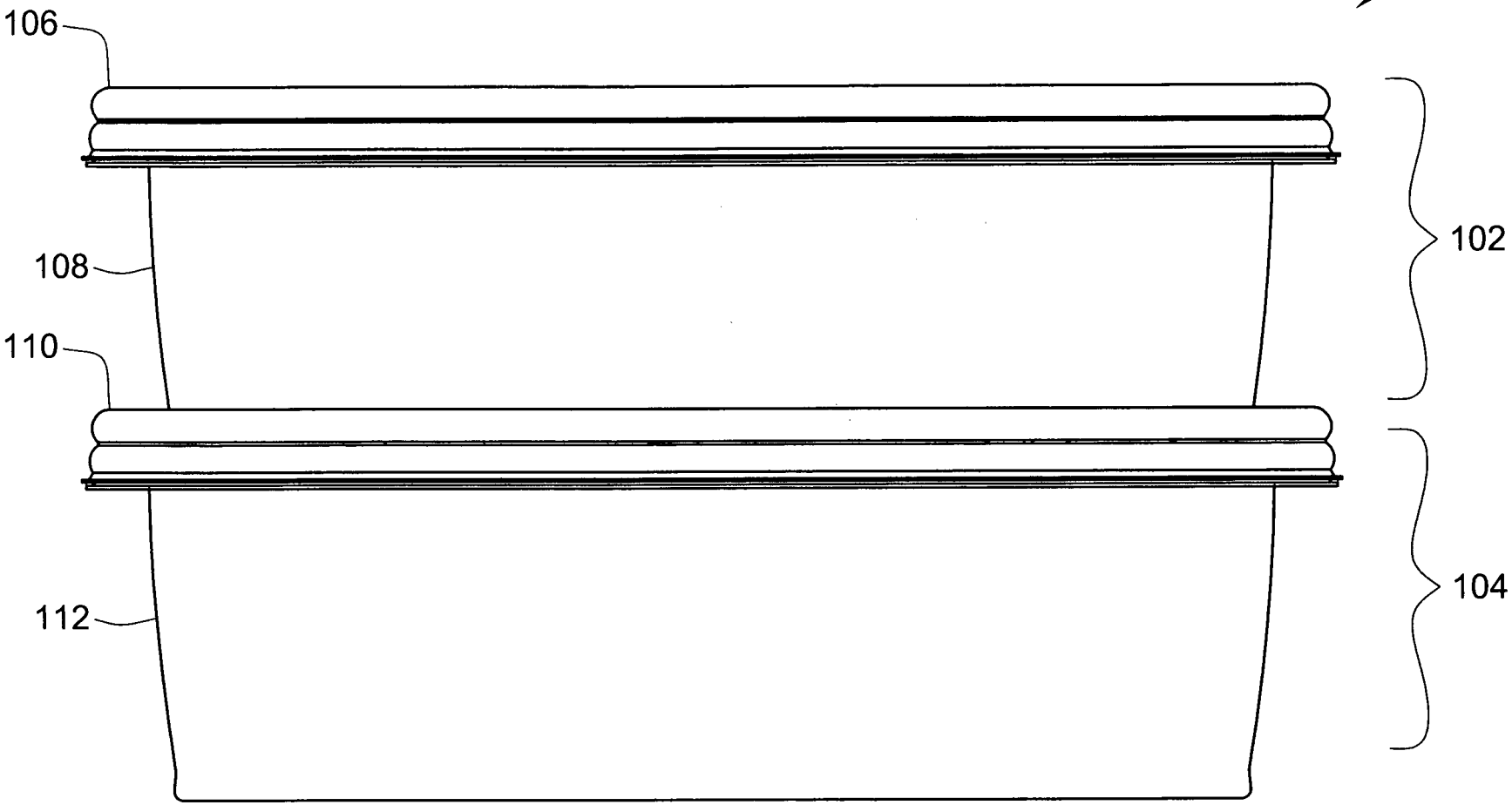
FIG. 5 is a side plan view of the locked container stack of FIG. 1.

The detailed views of FIGS. 3 and 4 depict embodiments of the closure portions used to engage the cover 110 with the base 112 of container 104, and the engagement portions used to engage the cover 110 of container 104 with the base 108 of container 102. In FIG. 3, the base 108 includes a bottom 300 and a sidewall 302 extending from the periphery of the bottom 300.

Turning to FIG. 4, the cover 110 includes a first closure portion 400 in the form of a raised locking ring. In the embodiment of FIG. 4, the cover 110 also includes a first engagement portion 402. The first closure portion 400 of the cover 110 can be engaged with a second closure portion 404 of the base 112 to provide a leak-resistant, re-sealable closure. In addition, the first engagement portion 402 of the cover 110 can be engaged with a second engagement portion 406 of the base 108 of container 102 to form the locking container stack 100.

The first closure portion 400 includes an inner wall 408, a retention bead 410, and an outer wall 412. The inner wall 408, the retention bead 410, and the outer wall 412 define a first sealing surface 414, which is part of the lower surface of the cover 110. The retention bead 410 can include rounded shoulders 416 and 418. The outer wall 412 extends between the retention bead 410 and a flange 420. The flange 420 can provide a convenient gripping surface to facilitate the removal of the cover 110 from the base 112.

As illustrated in FIG. 4, the second closure portion 404 of the base 112 is a raised locking ring that extends from an upper edge of the sidewall of the base 112. The second closure portion 404 includes an inner wall 422, a retention bead 424, and an outer wall 426. The inner wall 422, the retention bead 424, and the outer wall 426 define a second sealing surface 428, which is part of the upper surface of the base 112. The retention bead 424 can include a rounded shoulder 430. The outer wall 426 extends between the retention bead 424 and a flange 432. The flange 432 can provide a convenient gripping surface to facilitate the removal of the cover 110 from the base 112.

The first and second closure portions 400 and 404 can be configured to be slightly different in size to form an interference fit therebetween. The interference fit between the first and second closure portions 400 and 404 can provide a sealing engagement between the closure portions. As a result, when the two pieces are engaged, a positive seal can be formed between the first and second sealing surfaces 414 and 428 around the perimeters of the base 112 and of the cover 110.

The engagement of the first and second closure portions 400 and 404 may be accompanied by audible and/or tactile feedback indicating that the container is securely closed. The feedback may be provided by an interference fit and/or air displacement. Audible and/or tactile feedback may also occur in the cover-to-base engagement.

In the example of FIG. 4, the inner wall 408 of the first closure portion 400 of the cover 110 extends to the first engagement portion 402. This first engagement portion 402 includes an inner wall 434, a lower wall 436, and an outer wall 438. The outer wall 438 includes a cutback 440.

The second engagement portion 406 of the base 108 is complementary to the first engagement portion 402 of the cover 110. In the example of FIG. 4, the second engagement portion 406 includes an undercut 442. When the base 108 is pressed down onto the cover 110, the undercut 442 of the second engagement portion 406 of the base 108 engages with the cutback 440 of the first engagement portion 402 on the cover 110. The undercut 442 may be designed to provide either a frictional fit or a snap-fit engagement with the cutback 440 of the cover. In this manner, bases and covers can lock together into the locking container stack 100 of FIG. 1.

The first and second closure portions 400 and 404 and the first and second engagement portions 402 and 406 shown in FIG. 4 are examples only, and many other types of closure and engagement portions could be used with the present invention. For a first example, the first and second engagement portions 402 and 406 could be complementary locking rings. Alternatively, the second engagement portion 406 of the base 108 could include an exterior rib that is complementary to a detent groove in the first engagement portion 402 of the cover 110. As these and many other types of closure and engagement portions are well known in the art, they need not be discussed at length here. In other embodiments, the engagement portions may include discontinuous locking rings, detents, or buttons.

FIG. 5 again shows the locking container stack 100 from FIG. 1. The container 102 is shown in a sealed condition, with the cover 106 cooperating with the base 108 to define a sealed compartment. The cover 106 can be sufficiently flexible to allow a user to create a vacuum in the container 102 upon sealing. In order to create a vacuum, the user could, for example, depress the cover 106 during the closing of the container 102. A return force imparted upon the cover 106 by the resiliency of the material of the cover 106 will urge the cover 106 to return to its normal position, thereby creating a vacuum.

Figure 6:
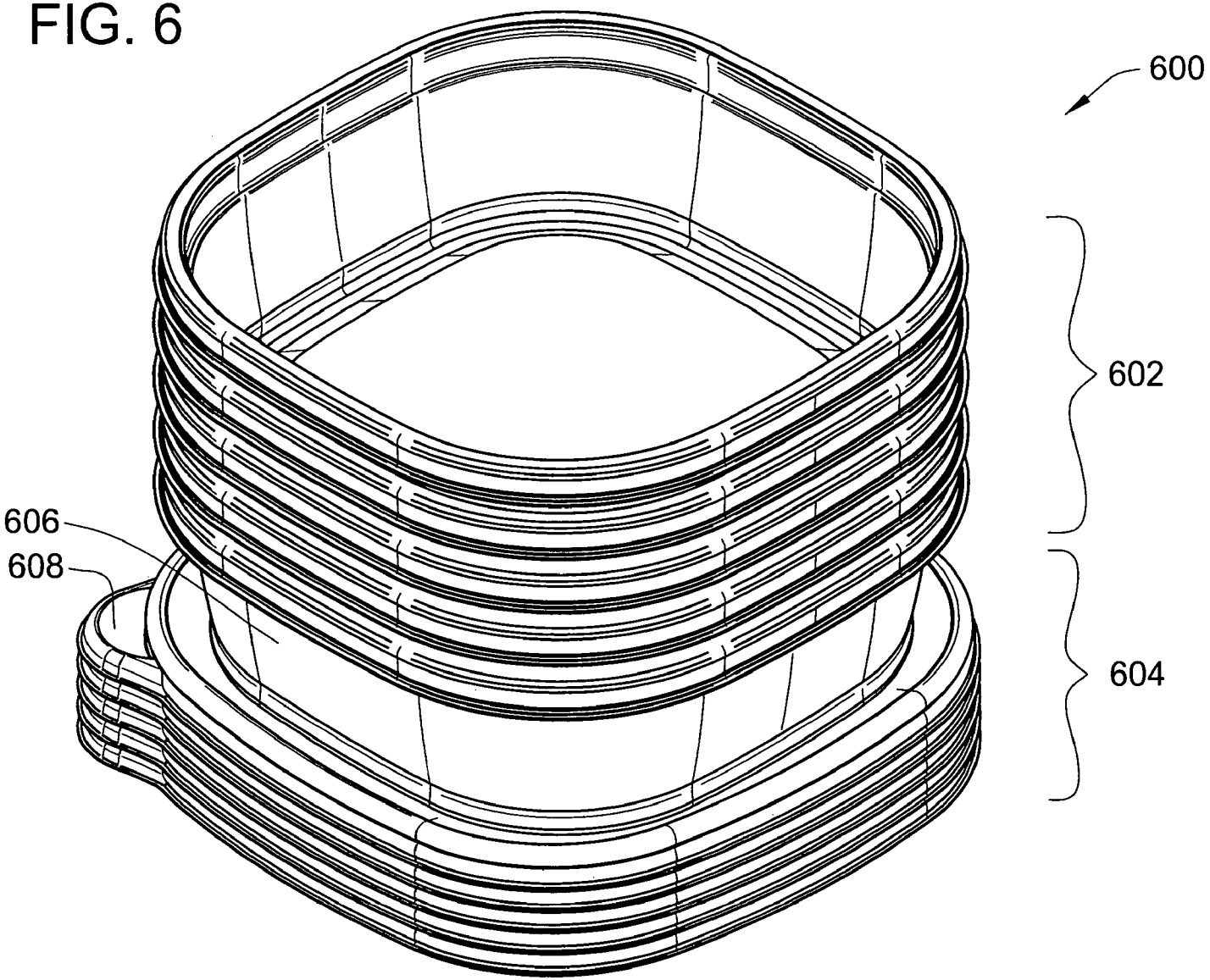
FIG. 6 is an isometric view of a locked stack of five container bases and their covers.

A second configuration of the present invention is illustrated in FIGS. 6 through 9. In FIG. 1, the containers 102 and 104 are in a sealed condition, appropriate when the containers are in use. FIG. 6, on the other hand, shows the utility of an embodiment of the invention when the containers are in storage. Several empty container bases are nested together in a stack 602 that sits on top of a stack 604 of container covers. This stack is more stable than similar stacks in the prior art for two reasons: (1) the lowermost container base 606 does not merely rest on the uppermost cover 608, but rather the base and cover are locked together, and (2) the covers are locked together in their stack 604.

In the example of FIG. 6, the containers are depicted as substantially square with rounded corners. In other embodiments of the present invention, the containers have other shapes such as rectangular, circular, or elliptical.

Figure 7:
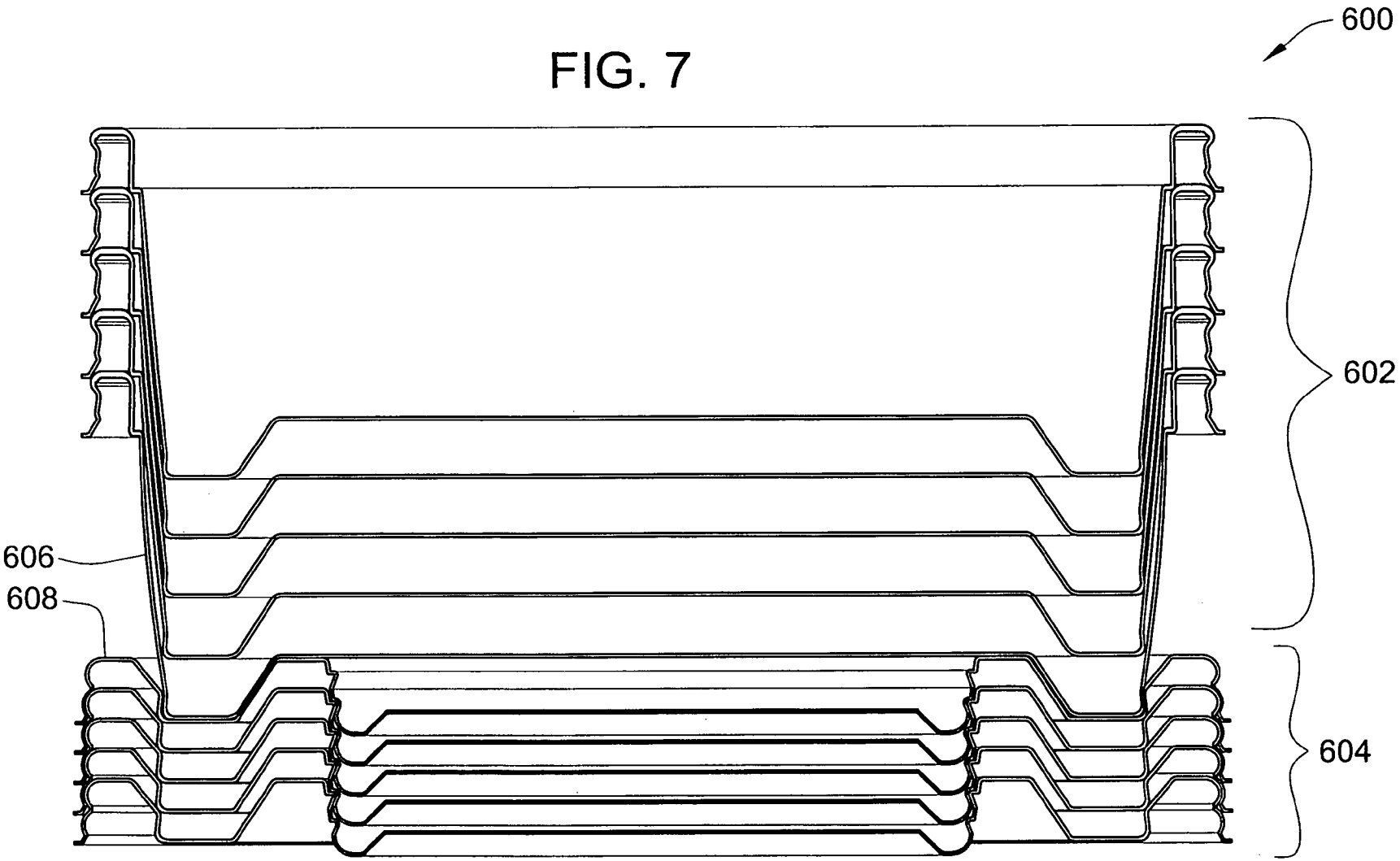
FIG. 7 is a side sectional view of the locked container stack of FIG. 6.
Figure 8:
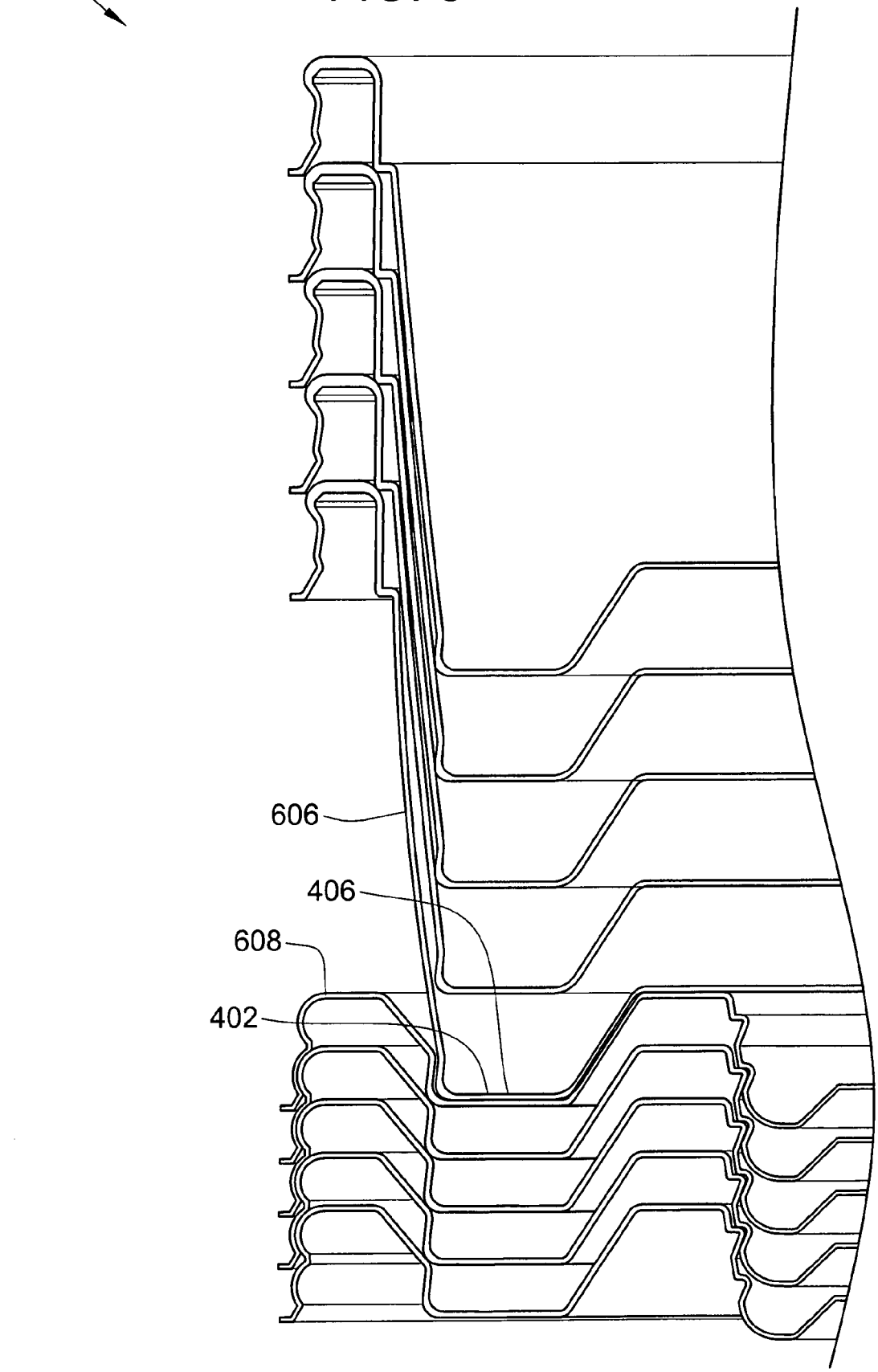
FIG. 8 is an enlarged, detail view of the area indicated in FIG. 7.

In FIG. 7, and especially in the detail of FIG. 8, the nesting of the container bases in their stack 602 is clearly seen. Aspects of this nesting are discussed below in reference to FIGS. 14 through 16.

FIG. 8 depicts how the lowermost container base 606 locks to the uppermost container cover 608. Repeating the terminology used above in relation to FIG. 4, the first engagement portion 402 of the cover 608 engages with the second engagement portion 406 of the base 606.

Figure 9:
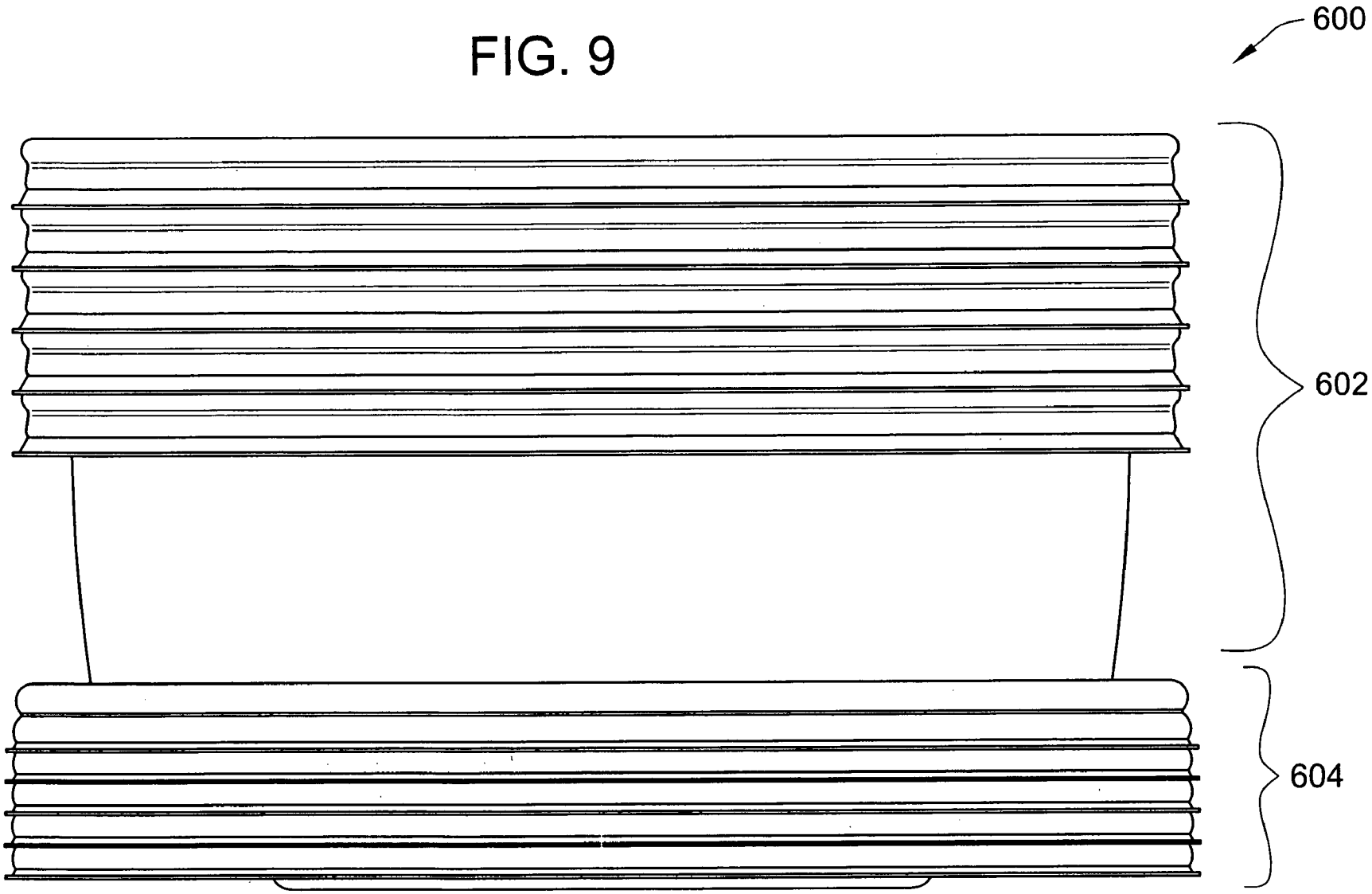
FIG. 9 is a side plan view of the locked container stack of FIG. 6.
Figure 10:
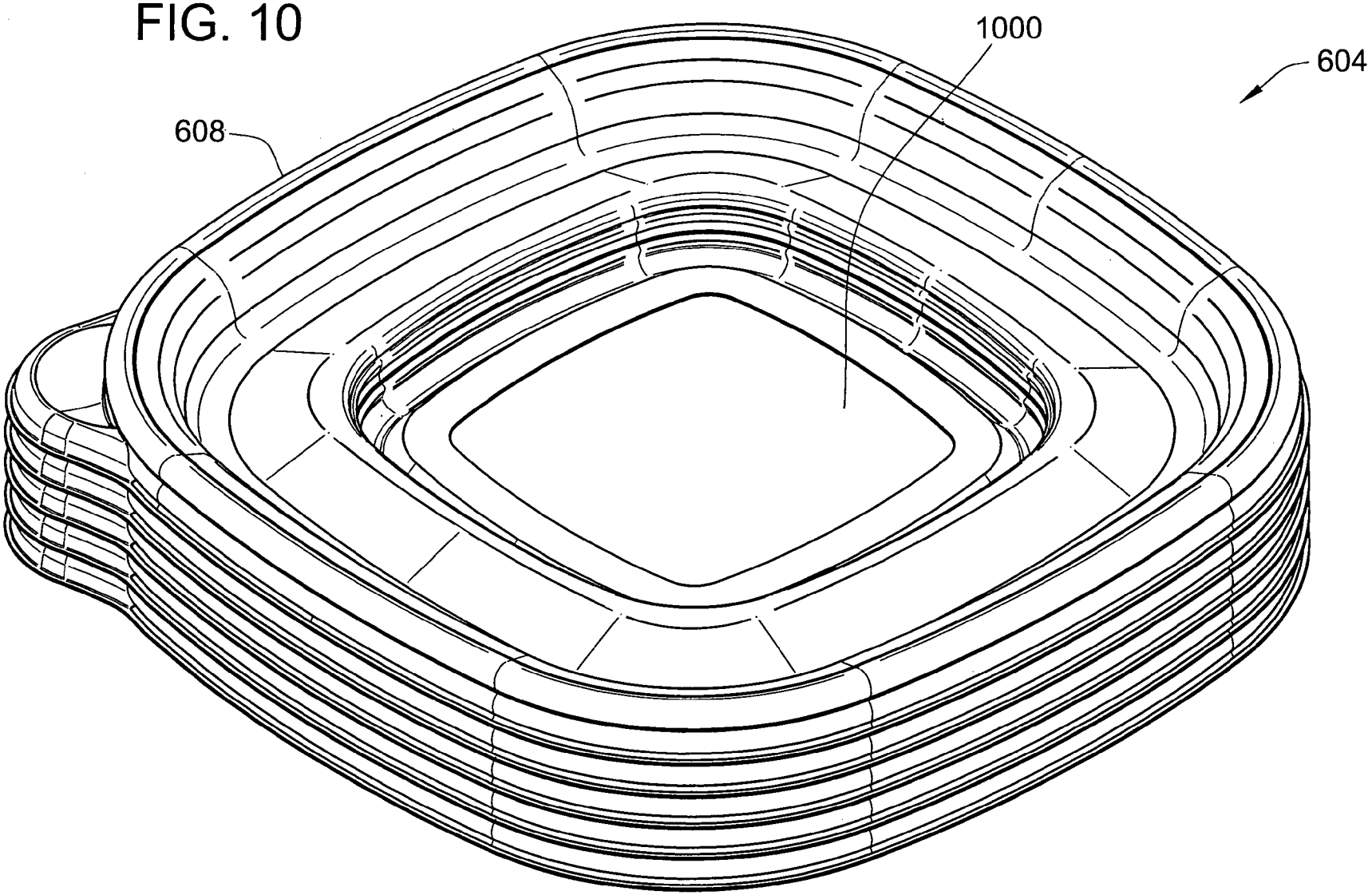
FIG. 10 is an isometric view of a locked stack of five container covers.

The stability of the storage stack 600 can be appreciated in the view of FIG. 9. The container bases are nested together in a stack 602, the container covers are locked together in a stack 604, and those two stacks are locked together. The order of the individual stacks can be changed with the cover stack 604 resting on top of the base stack 602. In that arrangement, the first closure portion 400 of the lowermost cover engages with the second closure portion 404 of the uppermost base.

FIGS. 10 through 13 illustrate aspects of the locked stack of container covers 604 from FIGS. 6 through 9. The container cover 608 can be constructed with a wall thickness thinner than that of a container base. The cover 608 can be made from any suitable plastic and can be made by any suitable technique, such as thermoforming. The cover 608 can be formed from polypropylene with a starting sheet thickness in the range of 7 to 60 mils and preferably 12 to 25 mils. Due to the thermoforming process, the wall thickness of the cover 608 can vary. A thinner container cover 608 reduces material costs and increases flexibility to more easily accommodate its removal from, and engagement with, a container base. The cover 608 can maintain adequate flexibility for proper sealing even during typical freezer temperatures.

The container cover 608 may have a central field 1000. The central field 1000 may include an embossed symbol such as a manufacturer's mark or may allow a user to attach a label or to write information, such as the date or user's name. When the central field 1000 includes a writeable area, that area could be of an opaque color which would receive a contrasting color from a writing instrument. The writeable area could be incorporated into the material for the container cover 608 or could be applied to that material by printing.

Figure 11:
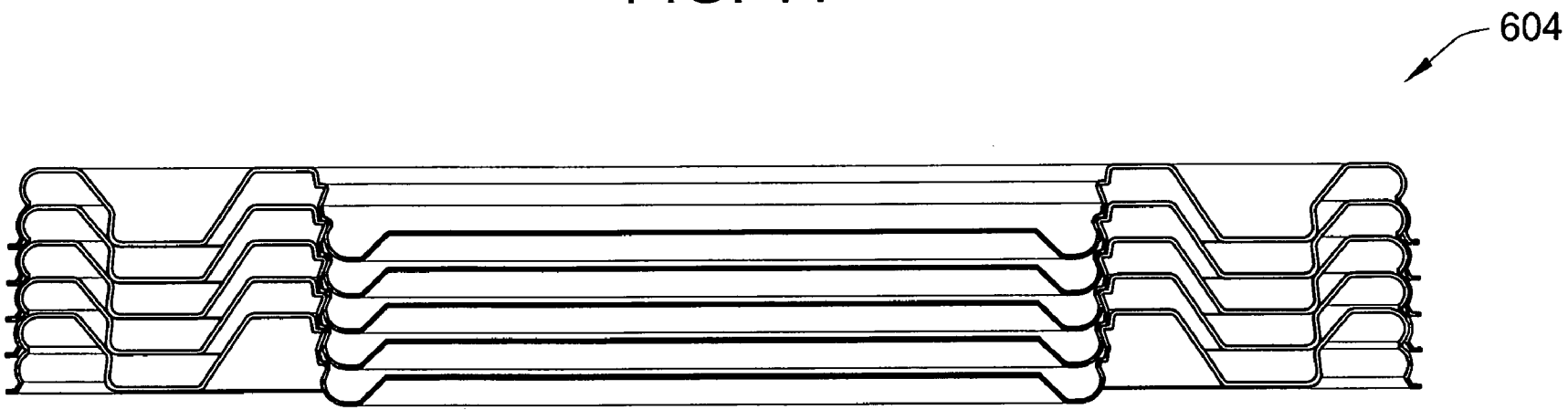
FIG. 11 is a side sectional view of the locked cover stack of FIG. 10.
Figure 13:
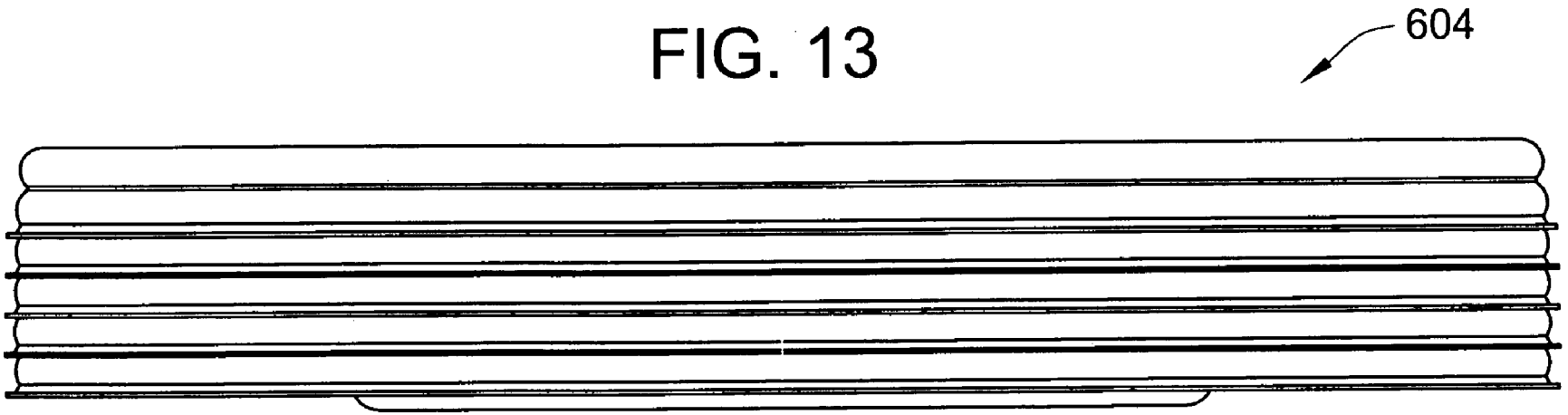
FIG. 13 is a side plan view of the locked cover stack of FIG. 10.

FIGS. 11 and 13 emphasize the compactness of the locked stack 604 of container covers. This compactness is a significant benefit of the present invention when covers are stored for future use.

Figure 12:
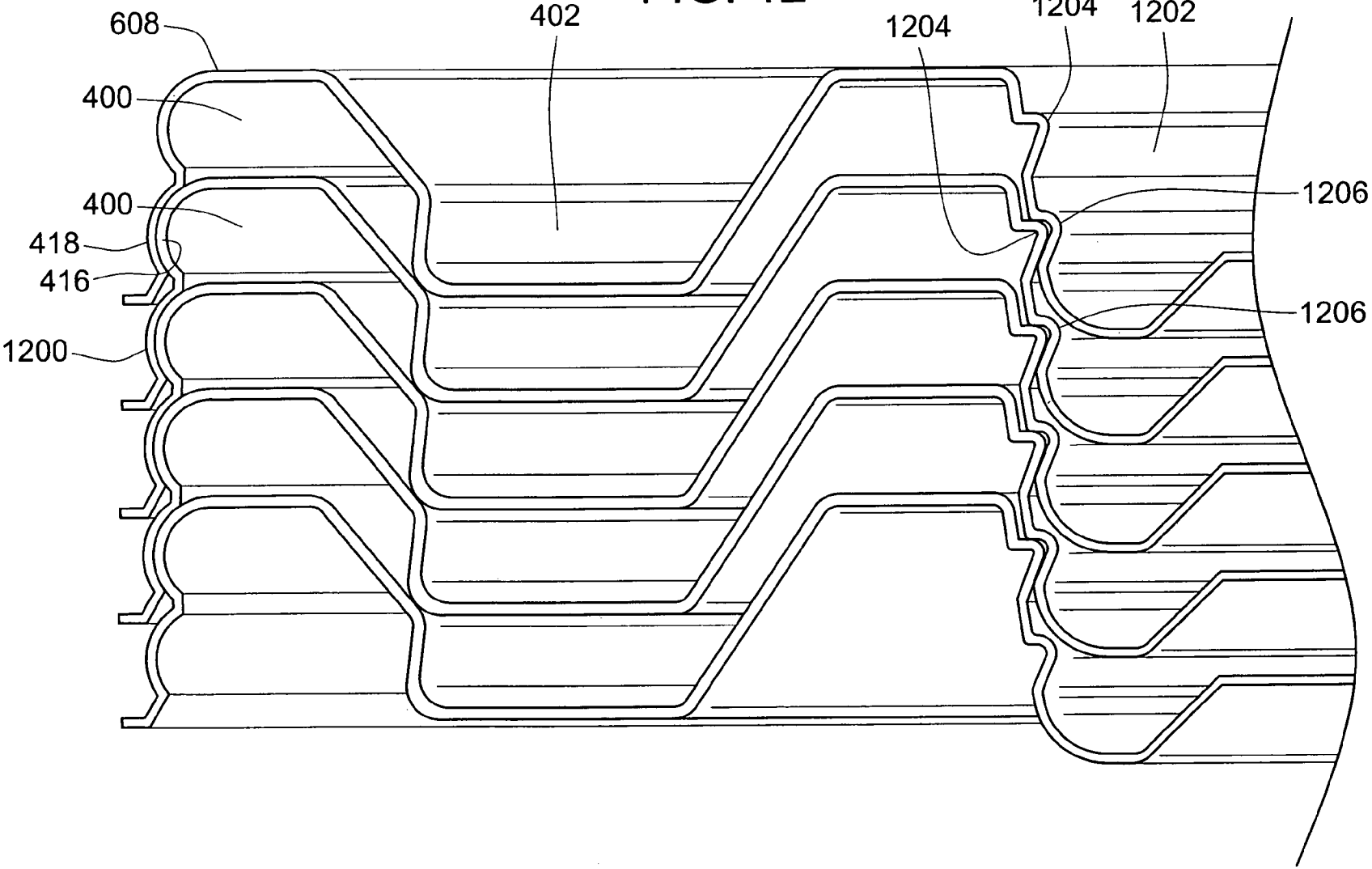
FIG. 12 is an enlarged, detail view of the area indicated in FIG. 11.

FIG. 12 details a few possible closure and engagement portions for locking the covers together. The particular embodiment of FIG. 12 illustrates a stack of locked covers 604 in which the covers are locked to one another by two different engagement mechanisms. First, and again returning to the language of the text accompanying FIG. 4, the first closure portion 400 of cover 608 engages with the first closure portion 400 of the cover 1200 directly beneath it in the stack. As illustrated, these first closure portions 400 are raised locking rings each with two shoulders 416 and 418. When cover 608 locks to cover 1200, the upper shoulder 416 of cover 1200 fits inside of, and engages with, the lower shoulder 418 of cover 608. In this manner, the covers are held together and form a structurally stable cover stack 604. The double locking ring arrangement allows the cover stack to be constructed with limited deflection during the engagement process. In addition, the deflection in the engaged position is limited.

To form the second cover-to-cover engagement mechanism illustrated in FIG. 12, each cover extends beyond its first engagement portion 402 to form a third engagement portion 1202. As illustrated, this third engagement portion 1202 consists of upper 1204 and lower 1206 protrusions. Each protrusion is convex on one side, and concave on the other. The lower protrusion 1206 of the cover 608 fits over and receives the upper protrusion 1204 of the cover 1200, thus locking the covers 608 and 1200 together. While optional, this third engagement portion 1202 enhances the structural stability of the cover stack 604, especially where the covers are thermoformed from thin material. If present, the third engagement portion 1202 can be formed in a variety of ways known to the art.

Figure 14:
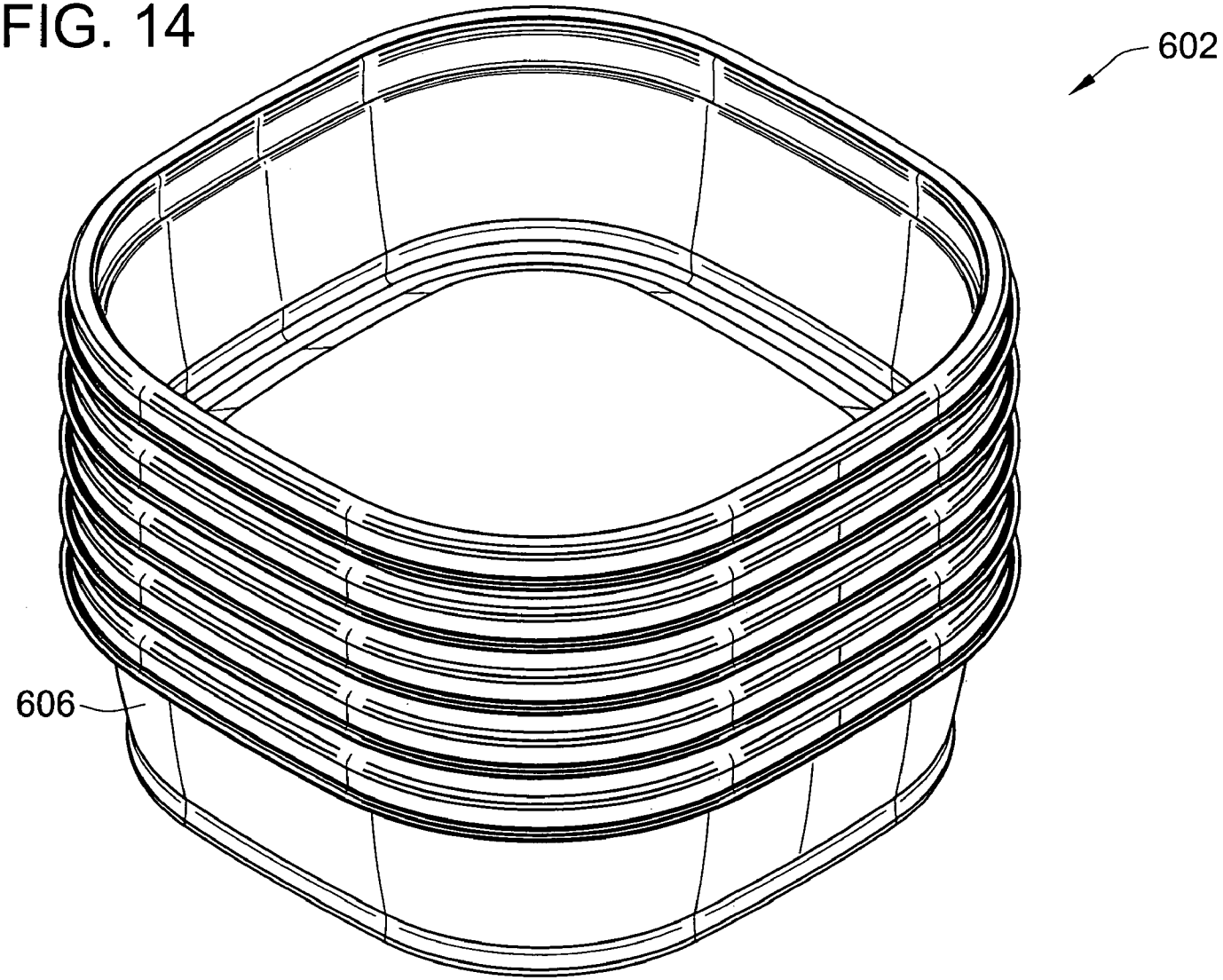
FIG. 14 is an isometric view of a nested stack of five container bases.
Figure 15:
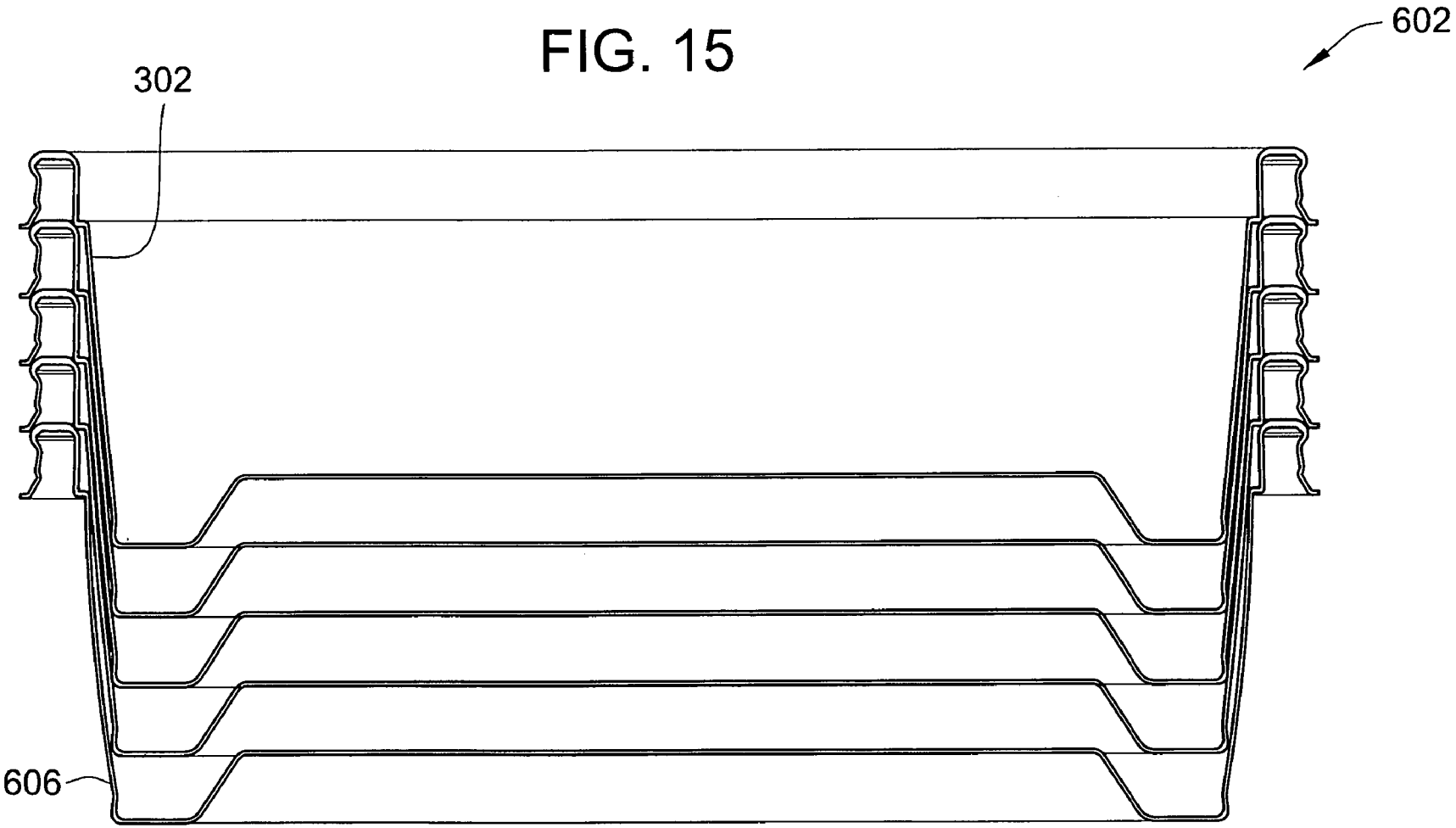
FIG. 15 is a side sectional view of the nested base stack of FIG. 14.
Figure 16:
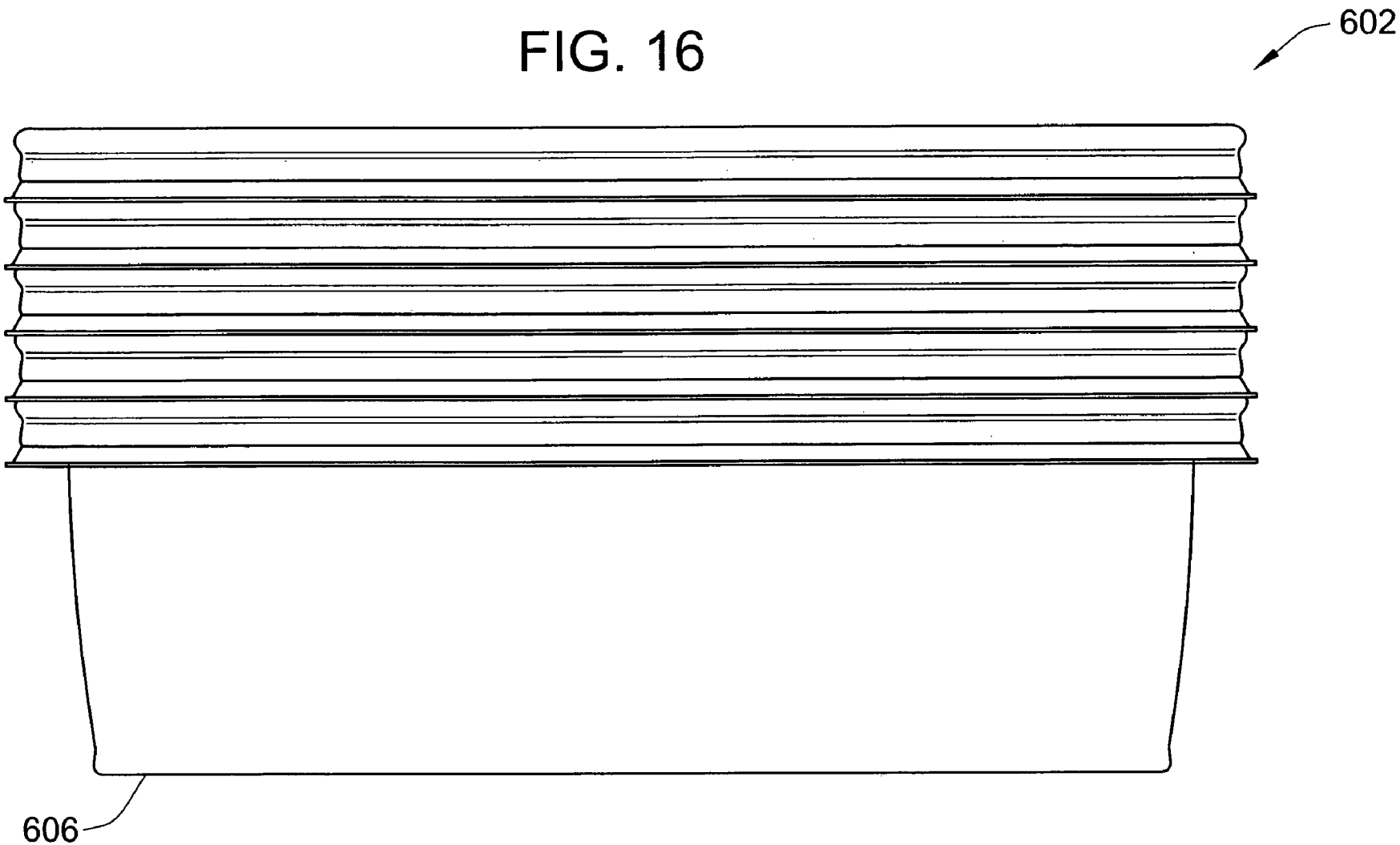
FIG. 16 is a side plan view of the nested base stack of FIG. 14.
Figure 17:
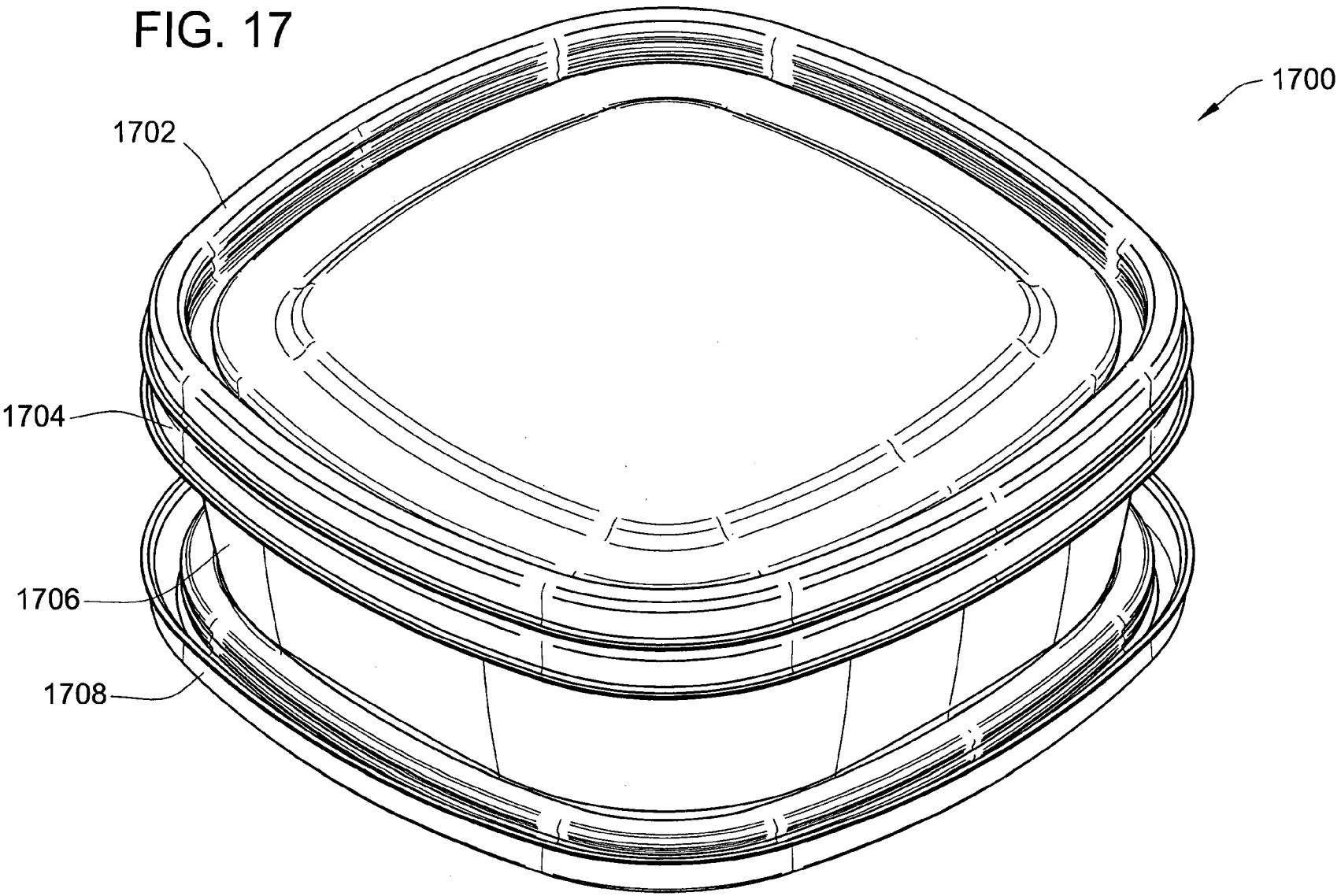
FIG. 17 is an isometric view of an embodiment of the present invention in which an inverted cover is locked to the bottom of a container base.
Figure 18:
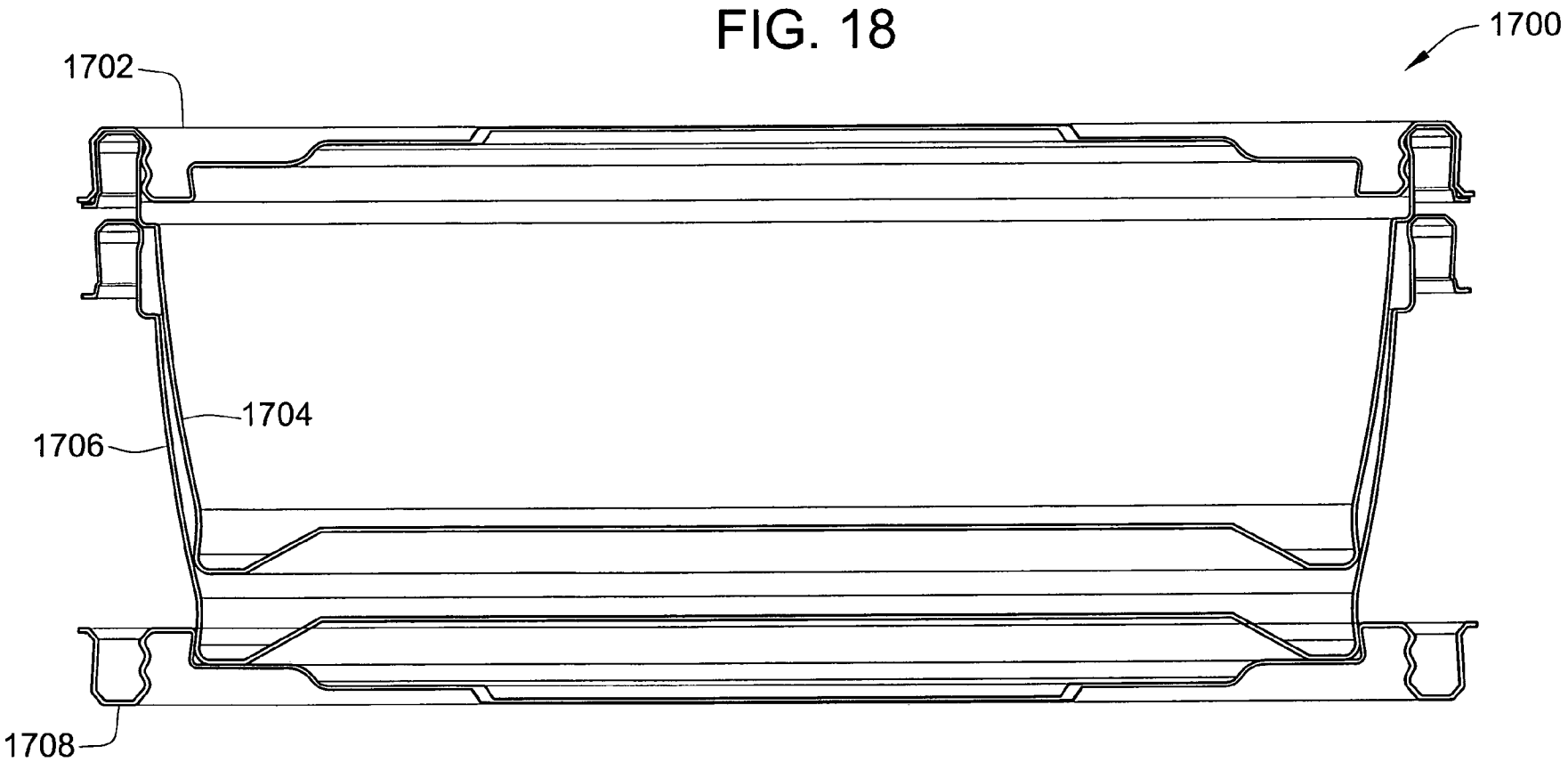
FIG. 18 is a side sectional view of the container stack with inverted cover of FIG. 17.

FIGS. 14 through 16 illustrate aspects of the nested stack of container bases 602 from FIG. 6. The container base 606 can be made from any suitable plastic with sufficient thickness to withstand without deforming the heat of microwave cooking and of top-shelf dishwashing. It should also remain sturdy during lifting while laden with hot food. The base 606 can be made from any suitable plastic and can be made by any suitable technique, such as co-extrusion, lamination, or overmolding. In one embodiment, the container base 606 is formed from polypropylene.

FIGS. 15 and 16 emphasize the compactness of the nested stack 602 of container bases. As with the locked stack of container covers 602, this compactness is a significant benefit of the present invention when the containers are stored for future use.

In the embodiment of FIG. 15, the walls 302 of the container bases are designed with a draft angle to accommodate nesting. The draft angle allows for the undercut 442 in the base of each container to nest within another container. The space between one container's undercut 442 and another container's sidewall 302 provides for ease of unnesting.

The container bases are shown nested in FIG. 15 but not locked together. In many applications, nesting the container bases without locking them together provides sufficient structural rigidity to the base stack 602. It is possible, however, to apply the techniques of the present invention to the container bases themselves and to thus provide a mechanism for locking the bases together. The same types of closure and engagement portions available for locking the covers together or for locking the covers to the bases can be adapted to locking the bases together.

FIGS. 17 through 22 present yet another embodiment of the present invention. The locked container stack 1700 of FIG. 17 includes, from top to bottom, a first container cover 1702 locked onto the top of a first container base 1704. The base 1704 is nested into a second base 1706. The bottom face of the second base 1706 is locked to a second cover 1708. However, unlike the embodiments described above, the second cover 1708 is upside down. The arrangement of the locked container stack 1700 may be best appreciated from the side view of FIG. 22 and from the side detail view of FIG. 19.

Figure 20:
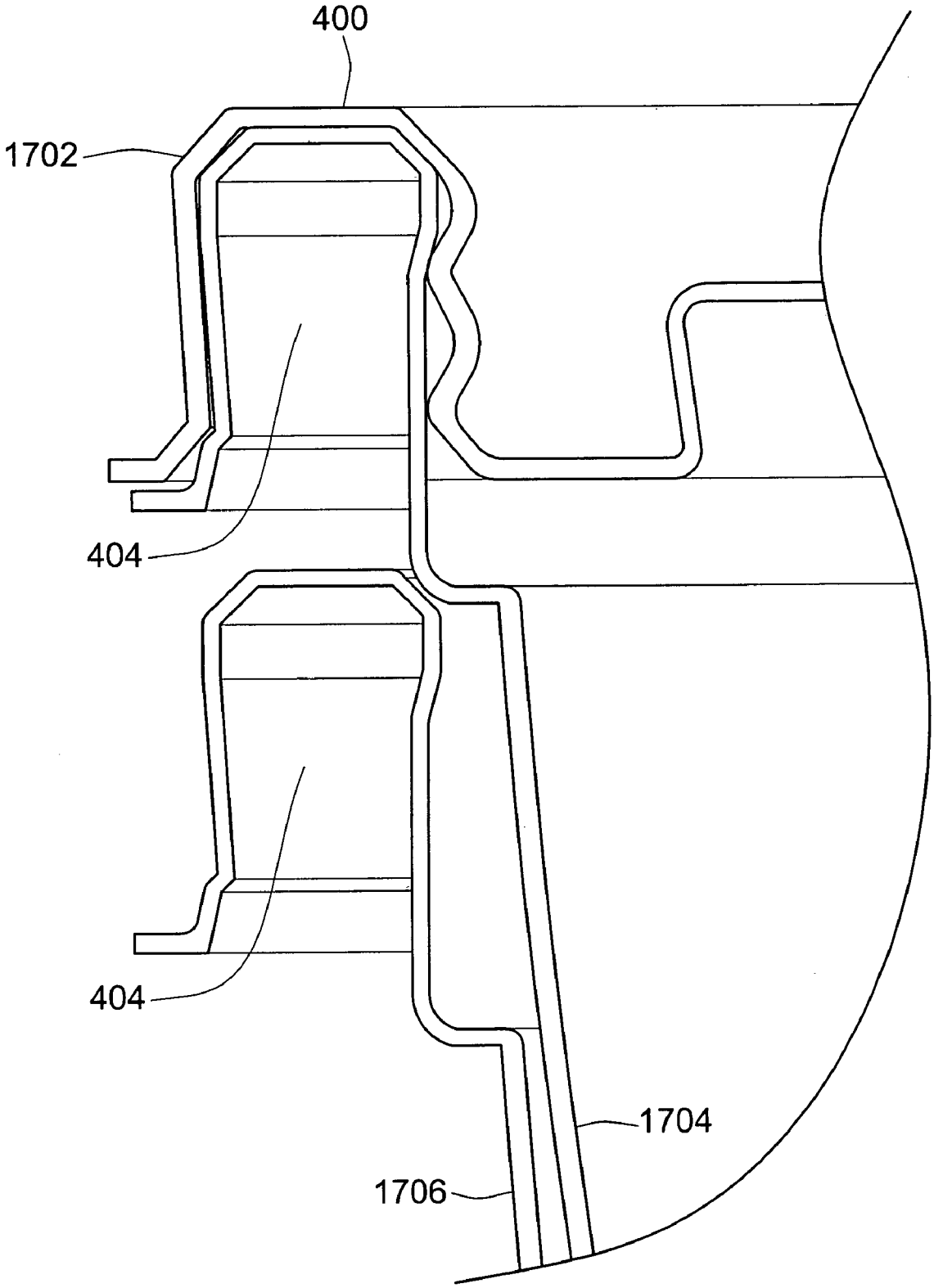
FIG. 20 is an enlarged, detail view of a first area indicated in FIG. 19.

As shown in FIG. 20, the first container cover 1702 is engaged with the first container base 1704 as described in the embodiments above. Using the terminology of FIG. 4, the first closure portion 400 of the cover 1702 sealingly engages with the second closure portion 404 of the base 1704. While the first 400 and second 404 closure portions are illustrated in FIG. 20 as raised locking rings, any suitable closure portion from the known art could be used here. For example, closure profiles may take the form of inside, outside, single, double, and triple undercuts in both continuous and discontinuous varieties.

Figure 19:
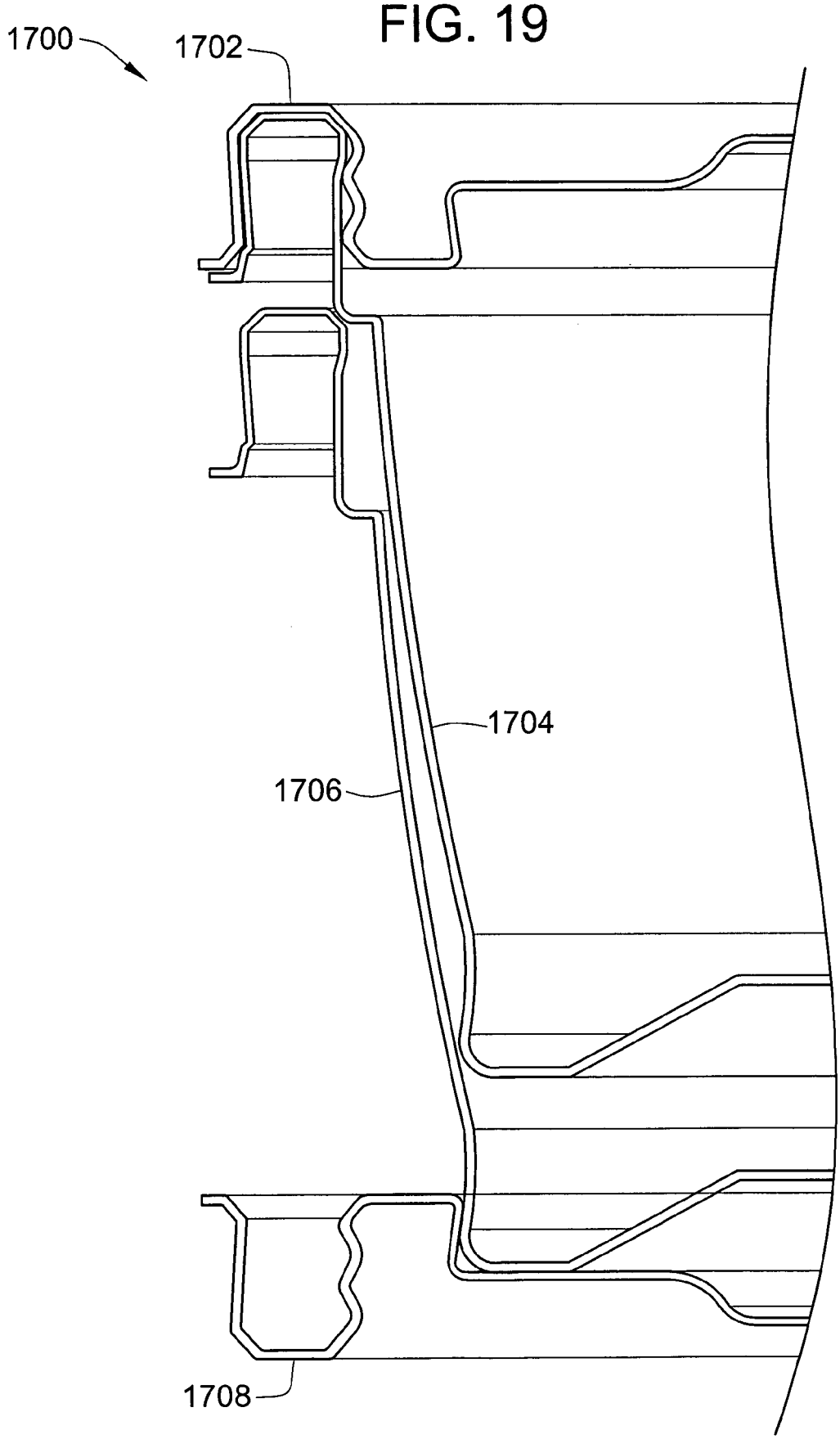
FIG. 19 is an enlarged, detail view of the area indicated in FIG. 18.

FIG. 19 shows the container base 1704 nesting within the container base 1706 in the same manner as described above in relation to FIGS. 14 through 16.

Figure 21:
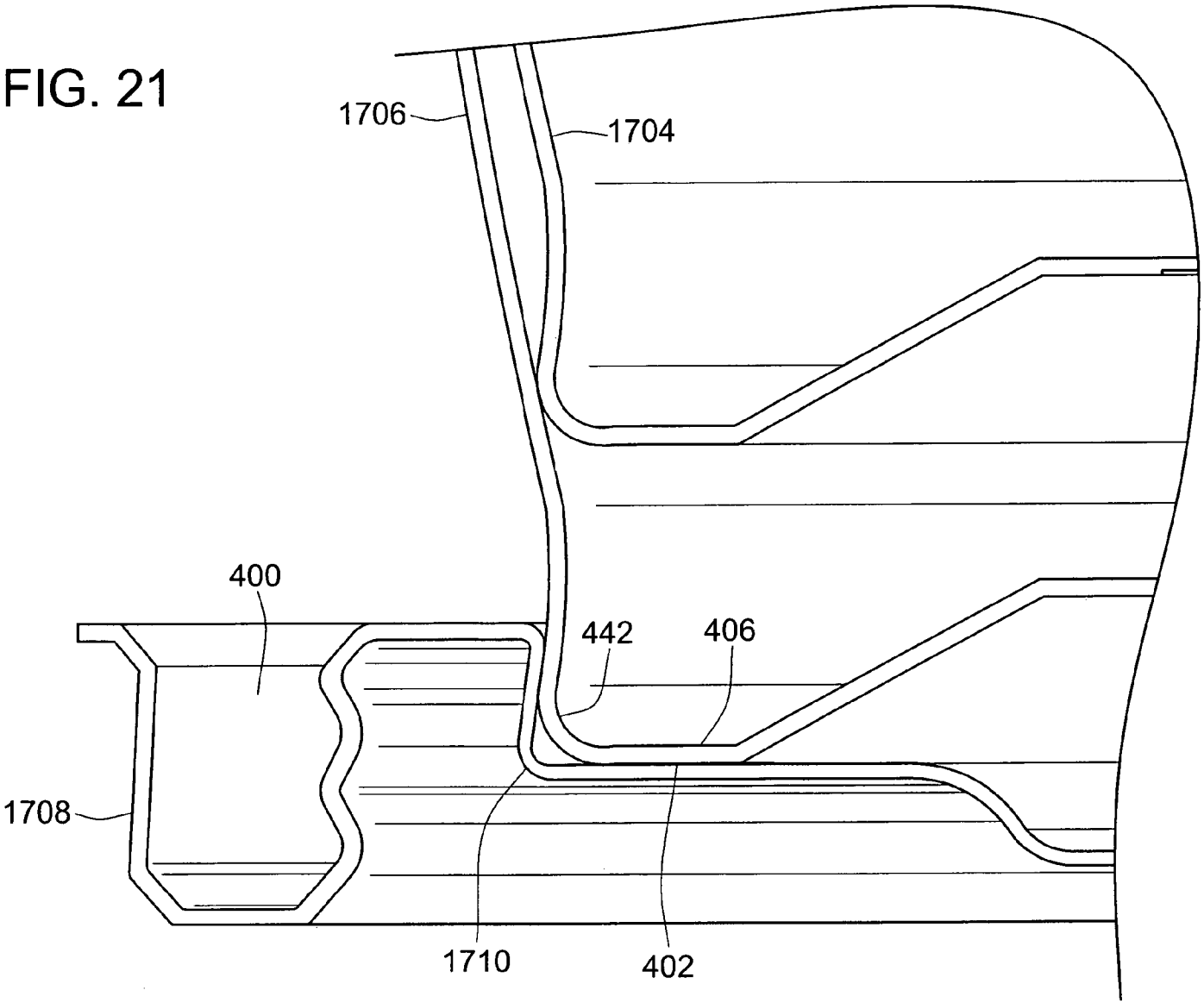
FIG. 21 is an enlarged, detail view of a second area indicated in FIG. 19.
Figure 22:
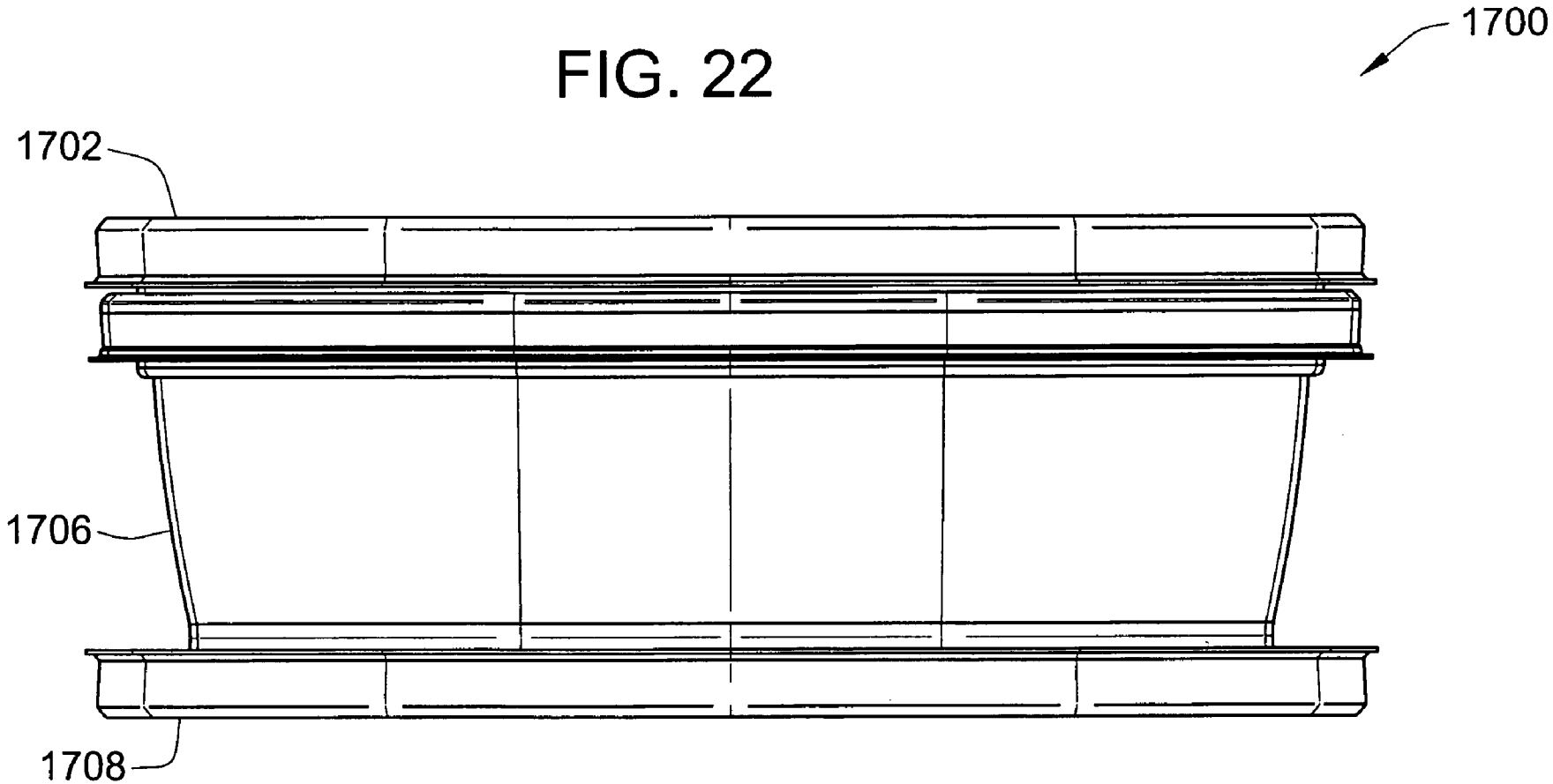
FIG. 22 is a side plan view of the container stack with inverted cover of FIG. 17.

Referring to FIG. 21, the second engagement portion 406 of the base 1706 is as described above in relation to FIG. 4. This second engagement portion 406 includes an undercut 442. In the inverted cover embodiment of FIG. 21, the first engagement portion 402 of the cover 1708 differs slightly from that shown in FIG. 4. There is a cutback 1710 which serves the same purpose as the cutback 440 of FIG. 4, but in this embodiment, it is inverted. When the base 1706 is pressed down onto the inverted cover 1708, the undercut 442 of the base 1706 engages with the cutback 1710 of the inverted cover 1708. The undercut 442 may be designed to provide either a frictional fit or a snap-fit engagement with the cutback 1710 of the inverted cover.

In another embodiment, a third engagement portion of the cover as discussed above in relation to FIGS. 10 through 13 could be added.

The container can be reusable, but it can also be constructed cheaply enough that consumers see it as a disposable item, with replacement covers and bases available separately for retail sale. The base and the cover can be fabricated by thermoforming a clarified polypropylene homopolymer material. In another embodiment, the container may be fabricated by thermoforming a clarified random copolymer polypropylene material. Alternative plastic materials which would be suitable for fabricating the container by thermoforming include PS (polystyrene), CPET (crystalline polyethylene terephthalate), APET (amorphous polyethylene terephthalate), HDPE (high density polyethylene), PVC (polyvinyl chloride), PC (polycarbonate), and foamed polypropylene. The material used can be generally transparent to allow a user to view the contents of the container.

The container may include a visual indication of closure between the container cover and the container base. The visual indication may be a color change in the area where the container cover engages the container base. In one embodiment, the closure portion on the container cover may be a first color and the closure portion on the container base may be a second color. When the closure portions are engaged, the first and second colors produce a third color which is visible to the user to indicate that the container is sealed.

The container may include a rough exterior surface to reduce slipping and to improve grasping by the user, especially if the user's hands are wet or greasy.

The container may include a self-venting feature. The pressure in the sealed container may increase when the sealed container and contents are heated in a microwave oven. Thus, the container cover may include a self-venting mechanism which opens when the pressure in the container exceeds a predetermined value.

The container may be divided to separate foods in the container. A divider may be integral with the container or may be a separate component. Either the base only may include a divider or both the base and the cover may each include a divider. The divider located in the cover may only partially engage the divider in the base so as to provide splash protection, or it may fully engage the divider in the base to provide varying degrees of inter-compartmental leak resistance.

The container may include a strip indicating the temperature of the container and its contents.

The gripping tab can include a relieved portion that provides less interference contact with the base during the removal or engagement of the cover while still providing an adequate closure portion to maintain proper sealing of the container. The relieved portions of the gripping tab permit venting by allowing a portion of the cover to be unsealed from the base while still maintaining a seal around the remaining perimeter of the container. This feature is useful in microwave cooking where the cover prevents food from splattering onto the inside surface of the microwave while still allowing the container to vent. By using the gripping tab, less force is required to remove the cover from the base. This lower opening force also reduces the possibility of container failure from stress and fatigue. The lower opening force can improve the ability of the user to maintain control over the container components while removing the cover from the base and thus to reduce the possibility of spilling the contents stored in the container.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

While the invention is described herein in connection with certain preferred embodiments, there is no intent to limit the present invention to those embodiments. On the contrary, it is recognized that various changes and modifications to the described embodiments will be apparent to those skilled in the art upon reading the foregoing description, and that such changes and modifications may be made without departing from the spirit and scope of the present invention. Skilled artisans may employ such variations as appropriate, and the invention may be practiced otherwise than as specifically described herein. Accordingly, the intent is to cover all alternatives, modifications, and equivalents included within the spirit and scope of the invention. Moreover, any combination of the above-described elements in all possible variations thereof is encompassed by the invention unless otherwise indicated herein or otherwise clearly contradicted by context.

We claim:

1. A first cover for a container, the first cover comprising:

a first closure portion, a first engagement portion, a central region, wherein the first closure portion is sealingly engageable with a second closure portion of a base so that when the first and second closure portions are engaged with each other, the first cover and the base define a substantially sealed storage area, wherein the first engagement portion is engageable with a second engagement portion of the base the first closure portion comprises locking rings, the locking ring of the first closure portion comprising an inner wall, a retention bead, and an outer wall, and wherein the locking rings include an upper shoulder and a lower shoulder, and each shoulder includes an inner surface and an outer surface;

wherein the respective outer walls of two or more first covers are lockingly engageable to one another in a lid stack; and wherein the outer surface of the upper shoulder of a lower first cover fits inside of, and engages with, the inner surface of the lower shoulder of an upper adjacent first cover; and wherein the central regions of two or more first covers are lockingly engageable with one another in a lid stack and the central regions have engagement portions having upper and lower protrusions wherein the upper and lower protrusions are convex on one side and concave on the other side.

2. The first cover of claim 1 wherein the first cover comprises thermoformed plastic.

3. The first cover of claim 1 wherein the first engagement portion comprises a cutback.

4. The first cover of claim 1 wherein the first engagement portion comprises a rib, and wherein the rib is engageable with a detent groove in the second engagement portion of the base.

5. The first cover of claim 1 wherein the first engagement portion comprises a detent groove, and wherein the detent groove is engageable with a rib in the second engagement portion of the base.

6. The first cover of claim 1 wherein the first cover comprises a gripping tab.

7. The first cover of claim 1 wherein the first cover comprises a top side and a bottom side and wherein when the first closure portion of the first cover is engaged with the second closure portion of the base, the bottom side of the first cover is in contact with the base.

8. The first cover of claim 7 wherein when the first engagement portion of the first cover is engaged with the second engagement portion of the base, the top side of the first cover is in contact with base.

9. The first cover of claim 7 wherein when the first engagement portion of the first cover is engaged with the second engagement portion of the base, the bottom side of the first cover is in contact with the base.

10. The first cover of claim 1 wherein the first cover comprises a third engagement portion, the third engagement portion of the first cover engageable with a third engagement portion of a second cover.

11. The first cover of claim 10 wherein the third engagement portion of the first cover comprises a rib and wherein the third engagement portion of the second cover comprises a detent groove, the rib of the third engagement portion of the first cover engageable with the detent groove of the third engagement portion of the second cover.

12. A system of container covers, the system comprising:

a first cover comprising a first closure portion, a first engagement portion, and a central portion, wherein the first closure portion is sealingly engageable with a second closure portion of a base so that when the first and second closure portions are engaged with each other, the first cover and the base define a substantially sealed storage area, and wherein the first engagement portion is engageable with a second engagement portion of the base, a second cover comprising a first closure portion and a first engagement portion, the first closure portion of the first cover and the first closure portion of the second cover each comprises a locking ring, the locking ring comprising an inner wall, a retention bead, and an outer wall, and wherein the locking rings include an upper shoulder and a lower shoulder, and each shoulder includes an inner surface and an outer surface;

wherein the respective outer walls of two or more first covers are lockingly engageable to one another in a lid stack, and wherein the outer surface of the upper shoulder of a lower first cover fits inside of, and engages with, the inner surface of the lower shoulder of an upper adjacent first cover; and wherein the central regions of two or more first covers are lockingly engageable with one another in a lid stack and the central regions have engagement portions having upper and lower protrusions wherein the lower protrusion of one cover fits over and receives the upper protrusion of a second cover.

13. The system of claim 12 wherein the first cover and the second cover each comprises thermoformed plastic.

14. The system of claim 12 wherein the first and second covers each comprises a gripping tab.

15. The system of claim 12 wherein the first and second covers each comprises a top side and a bottom side and wherein when the first closure portion of the first cover is engaged with the first closure portion of the second cover, the bottom side of the first cover is in contact with the top side of the second cover.

16. The system of claim 12 wherein the first and second covers each comprises a third engagement portion, the third engagement portion of the first cover engageable with the third engagement portion of the second cover.

17. The system of claim 16 wherein each third engagement portion comprises a rib and a detent groove, the rib of the third engagement portion of the first cover engageable with the detent groove of the third engagement portion of the second cover.

18. The system of claim 12 further comprising:

a third cover comprising a first closure portion and a first engagement portion, wherein the first closure portion of the third cover is engageable with the first closure portion of the second cover.

* * * * *